US012522430B2

(12) United States Patent
George et al.

(10) Patent No.: US 12,522,430 B2
(45) Date of Patent: Jan. 13, 2026

(54) PLATE LOCK DEVICE FOR BLOCKING DOORS OF CARGO CONTAINER

(71) Applicant: Hodor Innovations, LLC, Memphis, TN (US)

(72) Inventors: Mason George, Memphis, TN (US); Tyler S Smith, Collierville, TN (US)

(73) Assignee: OBYX SYSTEMS, LLC, Memphis, TN (US)

( * ) Notice: Subject to any disclaimer, the term of this patent is extended or adjusted under 35 U.S.C. 154(b) by 0 days.

(21) Appl. No.: 19/244,732

(22) Filed: Jun. 20, 2025

(65) Prior Publication Data

US 2025/0388391 A1 Dec. 25, 2025

Related U.S. Application Data

(60) Provisional application No. 63/710,889, filed on Oct. 23, 2024, provisional application No. 63/663,310, filed on Jun. 24, 2024.

(51) Int. Cl.
*B65D 90/22* (2006.01)
*B65D 90/00* (2006.01)

(52) U.S. Cl.
CPC ..... *B65D 90/22* (2013.01); *B65D 90/008* (2013.01)

(58) Field of Classification Search
CPC .... B65D 90/22; B65D 90/008; B65D 90/021; B65D 45/025; B65D 45/08; B65D 83/0817; B65D 47/0819
See application file for complete search history.

(56) References Cited

U.S. PATENT DOCUMENTS 3,813,117 A * 5/1974 Hackney, Jr. ..... B65D 90/008 292/259 R
4,057,170 A * 11/1977 Dougherty ..... E05D 11/00 220/323
5,290,077 A * 3/1994 Fleming ..... E05C 9/047 292/DIG. 60
5,975,592 A * 11/1999 Lin ..... E05C 1/06 292/159
7,752,875 B2 * 7/2010 Constantinou ..... E05C 9/1841 292/41
8,899,635 B2 * 12/2014 Nakanishi ..... E05B 63/0056 292/194

(Continued)

OTHER PUBLICATIONS

International Search Report and Written Opinion, regarding PCT/US2025/034578, issued Aug. 26, 2025 (7 pages).

*Primary Examiner* — Kareen K Thomas
(74) *Attorney, Agent, or Firm* — Robinson IP Law, PLLC

(57) ABSTRACT

Various implementations include a plate lock device for blocking doors of a cargo container. The device includes a plate and a locking mechanism. The plate has a plate longitudinal axis, a first side, a second side, a first plate end portion, and a second plate end portion. The locking mechanism is located at the first plate end portion. The locking mechanism includes a shaft, a cam, and a spring. The shaft has a shaft longitudinal axis and a first shaft end portion extending away from the second side of the plate. The cam is coupled to the first shaft end portion and is rotatable about the shaft longitudinal axis relative to the plate. The spring is configured to cause the cam to rotate from a first position to a second position. The cam is biased by the spring toward the first position and is urgable toward the second position.

20 Claims, 3 Drawing Sheets

(56) References Cited

U.S. PATENT DOCUMENTS

| | | | | |
|---|---|---|---|---|
| 2009/0113956 | A1* | 5/2009 | Hunt | E05C 9/025 70/113 |
| 2012/0031007 | A1* | 2/2012 | Jiang | E05C 17/025 49/394 |
| 2024/0104984 | A1* | 3/2024 | Pasma | G07C 9/00309 |

* cited by examiner

PLATE LOCK DEVICE FOR BLOCKING DOORS OF CARGO CONTAINER

BACKGROUND

Trailer locks are used to lock cargo containers. Current trailer locks fail to provide adequate protection against criminals, who can easily breach them with minimal effort. These breaches can cause hundreds of millions of dollars in damages to shippers, transportation providers, and insurance carriers. The vulnerability of international shipments is heightened by the availability of power tools at major home improvement stores, enabling virtually anyone to compromise the unsecured freight infrastructure. Thus, what is needed is a more secure way of locking cargo containers to protect international cargo from tampering during transit.

SUMMARY

Various implementations include a plate lock device for blocking doors of a cargo container. The device includes a plate and a locking mechanism. The plate has a plate longitudinal axis, a first side, a second side opposite and spaced apart from the first side, a first plate end portion, and a second plate end portion spaced apart along the plate longitudinal axis from the first plate end portion. The locking mechanism is located at the first plate end portion. The locking mechanism includes a shaft, a cam, and a spring. The shaft has a shaft longitudinal axis and a first shaft end portion extending away from the second side of the plate. The cam is coupled to the first shaft end portion. The cam is rotatable about the shaft longitudinal axis relative to the plate. The spring is configured to cause the cam to rotate from a first position to a second position. The cam is biased by the spring toward the first position and is urgable toward the second position.

In some implementations, the locking mechanism is a first locking mechanism. In some implementations, the device further includes a second locking mechanism located at the second plate end portion. In some implementations, the first locking mechanism is spaced part from the second locking mechanism by a distance of substantially 2,259 mm, as measured from the shaft longitudinal axis of the first locking mechanism to the shaft longitudinal axis of the second locking mechanism.

In some implementations, the cam has a minimum cross-sectional dimension as measured in a plane perpendicular to the shaft longitudinal axis. In some implementations, the minimum cross-sectional dimension is 63.5 mm or less. In some implementations, the minimum cross-sectional dimension is 51.5 mm or less.

In some implementations, the cam has a maximum cross-sectional dimension as measured in a plane perpendicular to the shaft longitudinal axis. In some implementations, the maximum cross-sectional dimension is greater than 51.5 mm. In some implementations, the maximum cross-sectional dimension is greater than 63.5 mm.

In some implementations, the cam has a nose portion. In some implementations, the cam further includes a cam bearing at least partially protruding from the nose portion. In some implementations, the cam bearing is rotatable about a bearing rotational axis that is parallel to the shaft longitudinal axis. In some implementations, the nose portion of the cam defines a recess. In some implementations, the cam bearing is at least partially disposed within the recess.

In some implementations, the first side of the plate defines a plate opening extending to the second side of the plate. In some implementations, the shaft is disposed within the plate opening. In some implementations, the device further includes a plate bearing disposed adjacent the plate opening. In some implementations, the shaft is rotatably supported by the plate bearing. In some implementations, the plate bearing includes a bushing disposed within the plate opening.

In some implementations, the shaft has a second shaft end portion opposite and spaced apart along the shaft longitudinal axis from the first shaft end portion. In some implementations, the spring is located at the second shaft end portion. In some implementations, the first side of the plate defines a plate opening extending to the second side of the plate. In some implementations, the shaft is disposed within the plate opening such that the spring is disposed along the first side of the plate and the cam is located along the second side of the plate.

In some implementations, the spring includes a torsion spring. In some implementations, the plate includes one or more spring stops extending from one of the first side or the second side of the plate. In some implementations, the torsion spring includes two legs. In some implementations, at least one of the legs is configured to contact the one or more spring stops as the cam rotates.

In some implementations, the plate includes metal. In some implementations, the plate includes steel.

In some implementations, the plate defines an edge notch extending from the first side to the second side. In some implementations, the edge notch includes a portion of an edge of the plate between the first plate end portion and the second plate end portion.

In some implementations, the plate defines one or more plate lifting openings extending from the first side to the second side. In some implementations, each of the one or more plate lifting openings is sized to accept a fork of a forklift.

BRIEF DESCRIPTION OF DRAWINGS

Example features and implementations of the present disclosure are disclosed in the accompanying drawings. However, the present disclosure is not limited to the precise arrangements and instrumentalities shown. Similar elements in different implementations are designated using the same reference numerals.

DETAILED DESCRIPTION

The devices, systems, and methods disclosed herein provide for a robust steel plate barrier that deters thieves with a locking system to properly secure a cargo container. When the plate is positioned on the top ISO corner castings of the container, the gravity-based locking system slides from the unlocked position to the locking position, securing the doors of the cargo container firmly. To unlock the doors of the cargo container, the plate must be lifted to cause the cam locks to move to the unlocked position. The weight of the metal plate ensures that the container cannot be opened without a precise unloading process, heavy machinery, and significant unhindered time—factors that are impractical for criminals.

The devices disclosed herein can be manufactured in various heights and thicknesses to enhance security and safety further. This customization allows for tailored solutions that meet specific security needs and challenges for the end user.

The devices disclosed herein are designed to seamlessly integrate with all modes of international transportation via a standard ISO container, meaning that the gravity-based locking system does not interfere with any commercial transport processes. This ensures that containers can move from ocean transport to final delivery without any issues. This compatibility guarantees that the devices disclosed herein enhance security without disrupting the logistics chain.

The devices disclosed herein represent a significant advancement in securing international cargo. Their robust design, customizable features, and seamless integration with transportation modes make them essential tools for protecting valuable shipments from criminal activities. By adopting the devices disclosed herein, users can mitigate risks and safeguard their cargo against tampering and theft during transit.

Various implementations include a plate lock device for blocking doors of a cargo container. The device includes a plate and a locking mechanism. The plate has a plate longitudinal axis, a first side, a second side opposite and spaced apart from the first side, a first plate end portion, and a second plate end portion spaced apart along the plate longitudinal axis from the first plate end portion. The locking mechanism is located at the first plate end portion. The locking mechanism includes a shaft, a cam, and a spring. The shaft has a shaft longitudinal axis and a first shaft end portion extending away from the second side of the plate. The cam is coupled to the first shaft end portion. The cam is rotatable about the shaft longitudinal axis relative to the plate. The spring is configured to cause the cam to rotate from a first position to a second position. The cam is biased by the spring toward the first position and is urgable toward the second position.

Figure 1:
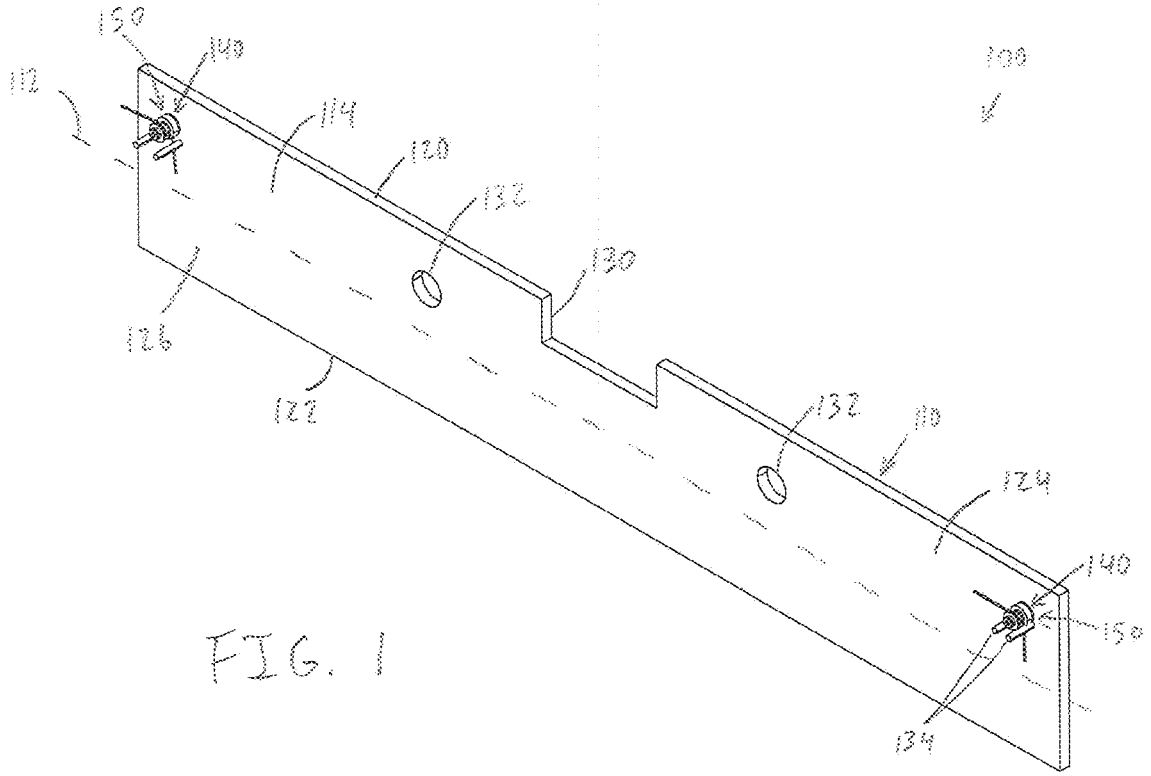
FIG. 1 is a first side perspective view of a plate lock device for blocking doors of a cargo container, according to one implementation.
Figure 2:
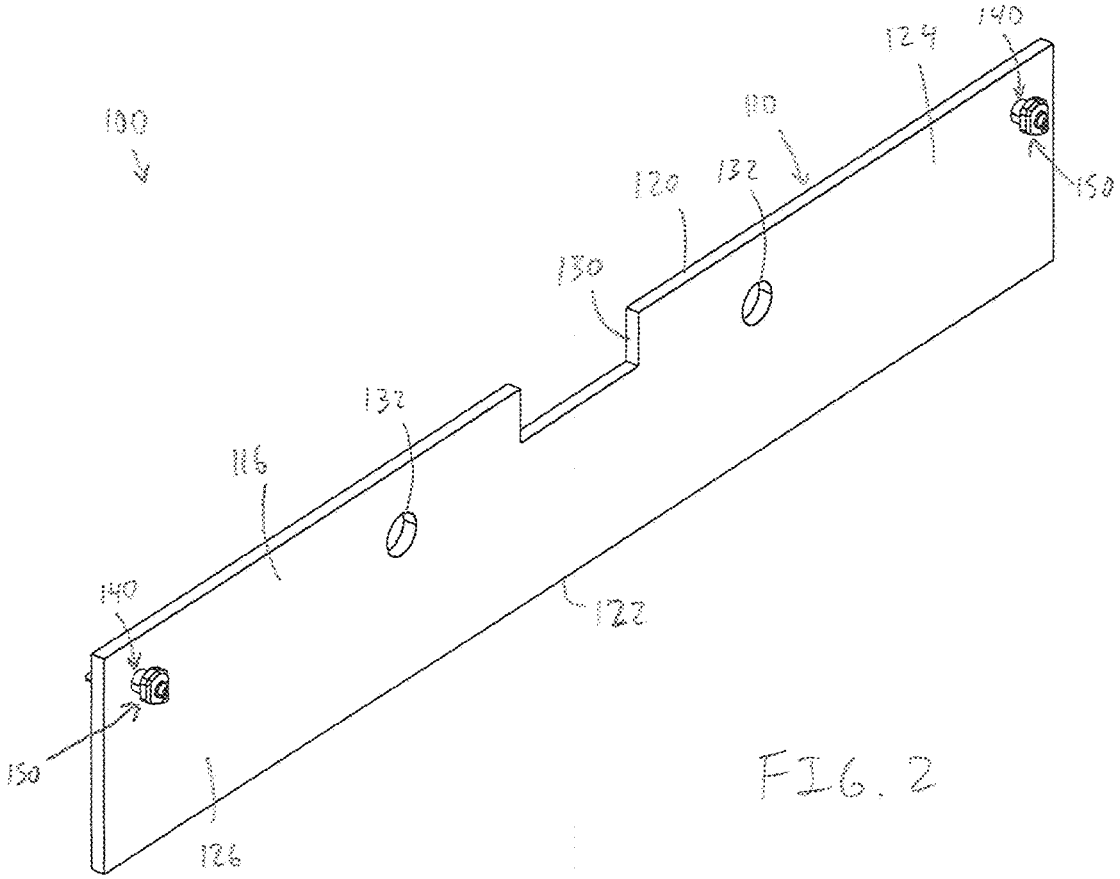
FIG. 2 is a second side perspective view of the device of FIG. 1.
Figure 3:
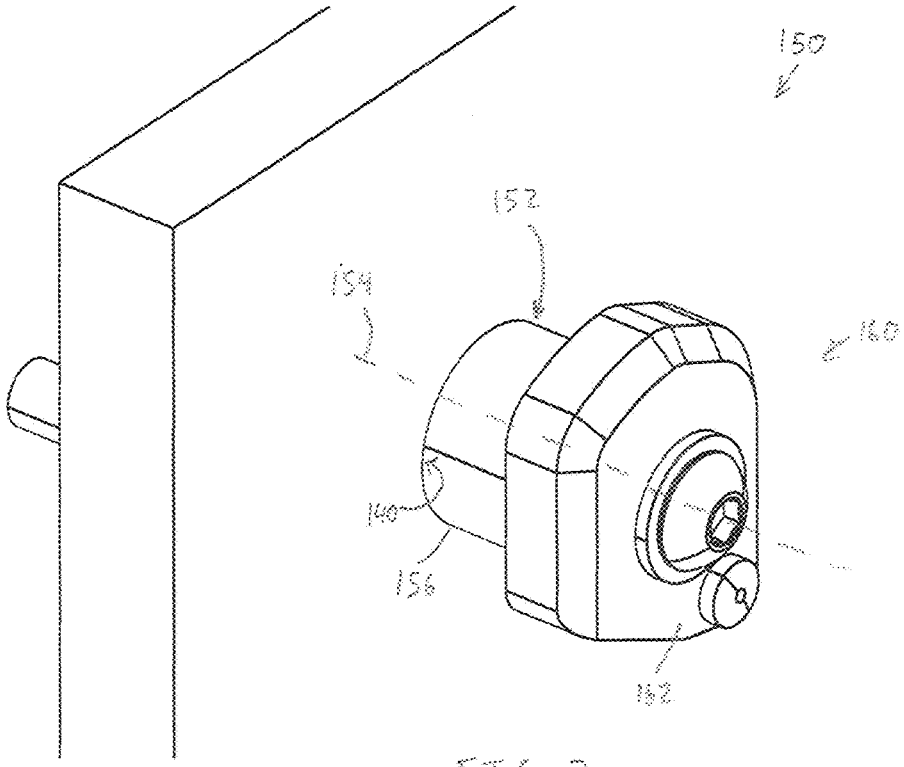
FIG. 3 is a detail perspective view of the cam of the locking mechanism of the device of FIG. 1.
Figure 4:
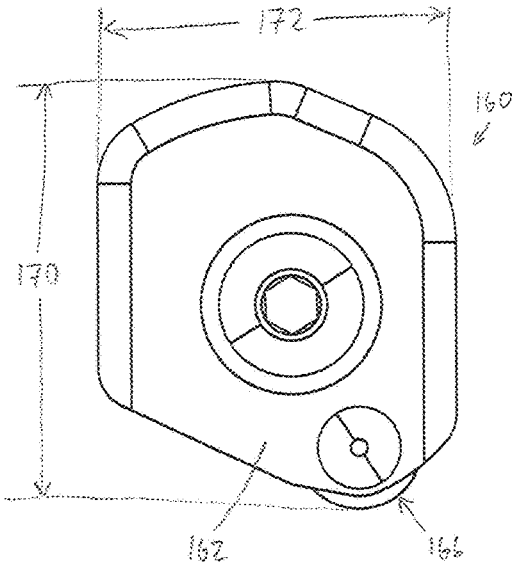
FIG. 4 is a front view of the cam of FIG. 3.
Figure 5:
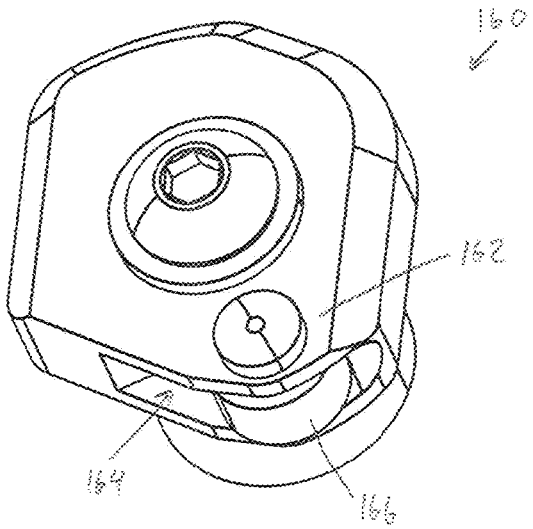
FIG. 5 is a bottom perspective view of the cam of FIG. 3.
Figure 6:
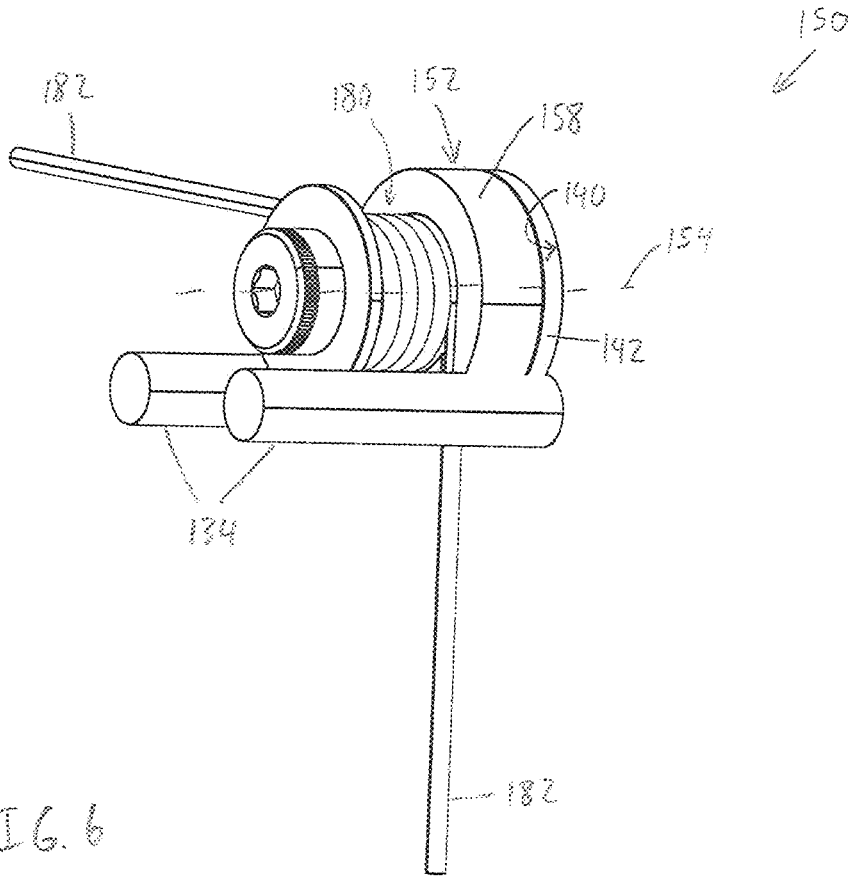
FIG. 6 is a detail perspective view of the spring of the locking mechanism of the device of FIG. 1.
Figure 7:
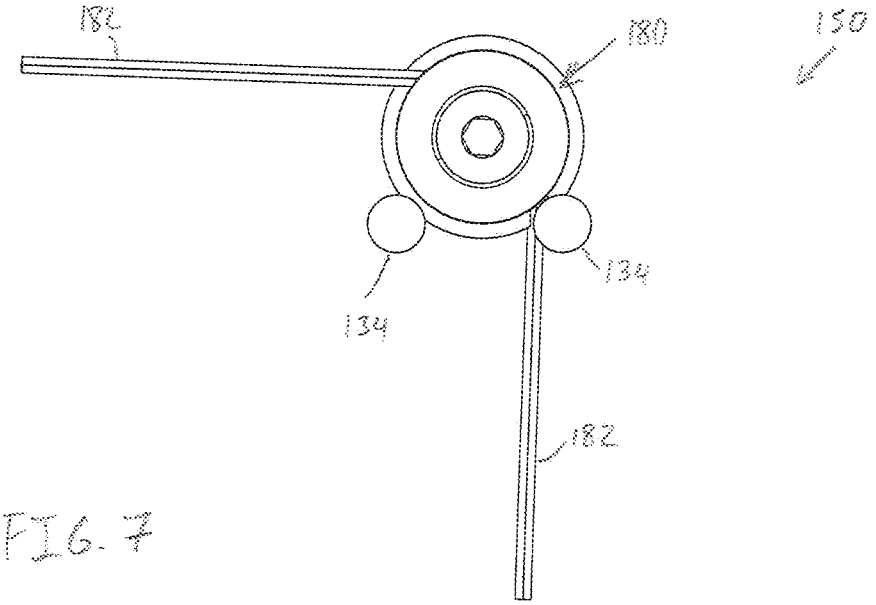
FIG. 7 is a front view of the spring of FIG. 6.

FIG. 1 shows a plate lock device 100 for blocking doors of a cargo container. The device 100 includes aspects of various implementations. The device 100 includes a plate 110 and two locking mechanisms 150.

The plate 110 is a steel plate having a plate longitudinal axis 112, a first side 114, a second side 116 opposite and spaced apart from the first side 114, a top edge 120, a bottom edge 122 opposite and spaced apart from the top edge 120, a first plate end portion 124, and a second plate end portion 126 spaced apart along the plate longitudinal axis 112 from the first plate end portion 124. Although the plate 110 shown in FIG. XX is made of steel, in some implementations, the plate is made out of any metal or any other material that makes the plate weigh too much for an average human to lift.

The plate 110 defines an edge notch 130 extending from the first side 114 to the second side 116 of the plate 110 along a central portion of the top edge 120 of the plate 110. The edge notch 130 is configured to accept the door closing mechanisms of the cargo container when the device 100 is coupled to the cargo container. Although the device 100 shown in FIG. XX defines an edge notch 130, it should be understood that, in some implementations, the device can include any other notches, openings, grooves, or channels necessary to allow the plate to avoid components of the cargo container such that the plate can abut the corner castings.

The plate 110 also defines two plate lifting openings 132 extending from the first side 114 to the second side 116. Each of the two plate lifting openings 132 is sized to accept a fork of a forklift. In use, a forklift or other lift can be used to lift the relatively heavy steel plate 110 of the device 100 via the plate lift openings 132 and move it into place for coupling to the corner castings of a cargo container. However, it should be understood that, in some implementations, the device can include any number of plate lifting openings. In some implementations, the device includes any other lifting opening or feature that allows the device to be lifted by machinery.

The first side 114 of the plate 110 defines two plate openings 140 that extend to the second side 116 of the plate 110. A first of the two plate openings 140 is defined by the first plate end portion 124, and a second of the two plate openings 140 is defined by the second plate end portion 126.

The two plate openings 140 are spaced part from each other by a distance of substantially 2,259 mm, as measured from the central axis of each plate opening 140. The standard distance, from center-to-center, between the front openings of ISO 1161 corner castings of cargo containers is 2,259 mm. Thus, the two plate openings 140 are alignable with the openings of the corner castings such that the longitudinal axes 154 of the shafts 152 of the locking mechanisms 150 disposed within the plate openings 140 are alignable with the front openings of the corner castings, as discussed in more detail below.

A bushing 142 is disposed in each of the two plate openings 140. However, in some implementations, any other type of plate bearing can be disposed in or adjacent to each of the plate openings to rotatably support the locking mechanism.

A different one of the two locking mechanisms 150 is located in each of the two plate openings 140. Each locking mechanism 150 includes a shaft 152, a cam 160, and a spring 180.

The shaft 152 has a shaft longitudinal axis 154, a first shaft end portion 156 extending away from the second side 116 of the plate 110, and a second shaft end portion 158 opposite the first shaft end portion 156 along the shaft longitudinal axis 154. The shaft 152 is rotatably disposed within the bushing 142 within the respective plate opening 140 such that the first shaft end portion 156 and the second shaft end portion 158 extend from either side of the plate 110.

The cam 160 is coupled to the first shaft end portion 156 and is rotatable about the shaft longitudinal axis 154 relative to the plate 110. The cam 160 is rotatable from a first position to a second position. The cam 160 has a nose portion 162 extending radially relative to the shaft longitudinal axis 154.

The cam 160 has a maximum cross-sectional dimension 170 as measured in a plane perpendicular to the shaft longitudinal axis 154 that includes the tip of the nose portion 162. The cam 160 also includes a minimum cross-sectional dimension 172 as measured in a plane perpendicular to the shaft longitudinal axis 154. The cam 160 is configured to be insertable into the front opening of an ISO 1161 corner casting when in the first position and to not be insertable through the front opening of the ISO 1161 corner casting when in the second position. Thus, the minimum cross-sectional dimension 172 must be smaller than the narrowest dimension of the front opening of the ISO 1161 corner casting, and when the cam 160 is rotated to the second position, the maximum cross-sectional dimension 170 must be larger than the narrowest dimension of the front opening of the ISO 1161 corner casting. The minimum cross-sectional dimension 172 of the cam 160 shown in FIGS. XX is 55 mm, but in some implementations, the minimum cross-sectional dimension of the cam is any size less than 55 mm. In some implementations, the minimum cross-sectional dimension of the cam is 51.5 mm or less. In some implementations, the minimum cross-sectional dimension of the cam is 63.5 mm or less. The maximum cross-sectional dimension 170 of the cam 160 shown in FIGS. XX is 67 mm, but in some implementations, the maximum cross-sectional dimension of the cam is any size greater than 67 mm. In some implementations, the maximum cross-sectional dimension of the cam is any size greater than 51.5 mm. In some implementations, the maximum cross-sectional dimension of the cam is greater than 63.5 mm.

In the first position, the nose 162 of the cam 160 is pointing toward the bottom edge 122 of the plate 110 such that the minimum cross-sectional dimension 172 is substantially oriented parallel to the plate longitudinal axis 112. In the second position, the nose 162 of the cam 160 is pointing substantially along the plate longitudinal axis 112 such that the maximum cross-sectional dimension 170 is substantially oriented parallel to the plate longitudinal axis 112.

The nose portion 162 of the cam 160 defines a recess 164 extending inwardly from a radially outwardly facing surface of the cam 160. The cam 160 includes a cam bearing 166 disposed within the cam recess 164. The cam bearing 166 is rotatably coupled to the cam 160 such that the axis of rotation of the cam bearing 166 is parallel to the shaft longitudinal axis 154. The cam bearing 166 at least partially protrudes from the nose portion 162 of the cam 160.

The spring 180 is located at the second shaft end portion 158 and is disposed along the first side 114 of the plate 110 opposite the cam 160 along the second side 116 of the plate 110. The spring 180 is stationary relative to the shaft 152 such that the spring 180, the shaft 152, and the cam 160 rotate together relative to the plate 110. The spring 180 shown in FIG. X is a torsion spring having two legs 182 extending from opposite ends of the spring 180. The plate 110 includes two spring stops 134 extending from the first side 114 of the plate 110 adjacent each of the plate openings 140. At least one of the legs 182 of a spring 180 is configured to contact the spring stops 134 as the cam 160 rotates such that, when the cam 160 is rotated, the spring 180 biases the cam 160 back toward the first position. However, the spring 180 is deformable to allow the cam 160 to be urgable toward the second position.

In use, the forks of a forklift are inserted through the plate lift openings 132. The plate 110 is then lifted and positioned by the forklift until the shaft longitudinal axis 154 of each locking mechanism 150 is aligned with the front openings of the top corner castings of a cargo container. The spring 180 biases the cams 160 of the two locking mechanisms 150 toward the first position such that the minimum cross-sectional dimensions 172 of the cams 160 are oriented with the narrowest dimension of the front opening of the corner castings. Because the minimum cross-sectional dimensions 172 of the cams 160 are less than the narrowest dimension of the front opening of the corner castings, the cams 160 are able to be inserted into the front openings of the corner castings using the forklift.

The forklift then lowers the device 100 until the cam bearings 166 of the nose portions 162 of the cams 160 contact a bottom surface within the corner casting. As the weight of the steel plate 110 is shifted from the forklift to the cam bearings 166, the geometry of the cam bearings 166 being offset from the shaft longitudinal axis 154 causes the cams 160 to rotate from the first position to the second position. Once rotated to the second position, the maximum cross-sectional dimensions 170 of the cams 160 are oriented with the narrowest dimension of the front opening of the corner castings. Because the maximum cross-sectional dimensions 170 of the cams 160 are greater than the narrowest dimension of the front opening of the corner castings, the cams 160 are no longer able to be removed from the front openings of the corner castings. In this position, the plate 110 of the device 100 blocks the door of the cargo container to block the door in the closed position.

To remove the device 100, the device 100 must be lifted such that the cams 160 are no longer resting on bottom surfaces in the corner castings. Due to the weight of the steel plate 110 of the device 100, a machine such as a forklift is necessary to lift the device 100. This prevents a person from simply removing the device 100 and opening the doors of the cargo container.

Once the device 100 is lifted using a forklift or other machine such that the weight of the steel plate 110 is removed from the cams 160, the spring 180 is able to bias the cams 160 back toward the first position. As discussed above, the cams 160 are able to be removed from the front openings of the corner castings when in the first position. Thus, once the weight of the plate 110 is removed from the cams 160, the device 100 can be removed from the corner castings such that the door of the cargo container can be opened.

During use, the device 100 has the advantage of only blocking the front openings of the top corner castings. This ensures that the top openings of the top corner castings are still available for their intended purpose of coupling stacked cargo containers to each other.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A plate lock device for blocking doors of a cargo container, the device comprising:

a plate having a plate longitudinal axis, a first side, a second side opposite and spaced apart from the first side, a first plate end portion, and a second plate end portion spaced apart along the plate longitudinal axis from the first plate end portion;

a locking mechanism located at the first plate end portion, the locking mechanism including:

a shaft having a shaft longitudinal axis and a first shaft end portion extending away from the second side of the plate, a cam coupled to the first shaft end portion, wherein the cam is rotatable about the shaft longitudinal axis relative to the plate, and a spring configured to cause the cam to rotate from a first position to a second position, wherein the cam is biased by the spring toward the first position and is urgable toward the second position by a weight of the plate when the cam contacts a bottom surface within a corner casting of the cargo container.

2. The device of claim 1, wherein the locking mechanism is a first locking mechanism, the device further including a second locking mechanism located at the second plate end portion.

3. The device of claim 2, wherein the first locking mechanism is spaced part from the second locking mechanism by a distance of substantially 2,259 mm, as measured from the shaft longitudinal axis of the first locking mechanism to the shaft longitudinal axis of the second locking mechanism.

4. The device of claim 1, wherein the cam has a minimum cross-sectional dimension as measured in a plane perpendicular to the shaft longitudinal axis, wherein the minimum cross-sectional dimension is 63.5 mm or less.

5. The device of claim 4, wherein the minimum cross-sectional dimension is 51.5 mm or less.

6. The device of claim 1, wherein the cam has a maximum cross-sectional dimension as measured in a plane perpendicular to the shaft longitudinal axis, wherein the maximum cross-sectional dimension is greater than 51.5 mm.

7. The device of claim 6, wherein the maximum cross-sectional dimension is greater than 63.5 mm.

8. The device of claim 1, wherein the cam has a nose portion, wherein the cam further includes a cam bearing at least partially protruding from the nose portion, wherein the cam bearing is rotatable about a bearing rotational axis that is parallel to the shaft longitudinal axis.

9. The device of claim 8, wherein the nose portion of the cam defines a recess, wherein the cam bearing is at least partially disposed within the recess.

10. The device of claim 1, wherein the first side of the plate defines a plate opening extending to the second side of the plate, wherein the shaft is disposed within the plate opening.

11. The device of claim 10, further comprising a plate bearing disposed adjacent the plate opening, wherein the shaft is rotatably supported by the plate bearing.

12. The device of claim 11, wherein the plate bearing includes a bushing disposed within the plate opening.

13. The device of claim 1, wherein the shaft has a second shaft end portion opposite and spaced apart along the shaft longitudinal axis from the first shaft end portion, wherein the spring is located at the second shaft end portion.

14. The device of claim 13, wherein the first side of the plate defines a plate opening extending to the second side of the plate, wherein the shaft is disposed within the plate opening such that the spring is disposed along the first side of the plate and the cam is located along the second side of the plate.

15. The device of claim 1, wherein the spring includes a torsion spring.

16. The device of claim 15, wherein the plate includes one or more spring stops extending from one of the first side or the second side of the plate, wherein the torsion spring includes two legs, wherein at least one of the legs is configured to contact the one or more spring stops as the cam rotates.

17. The device of claim 1, wherein the plate comprises metal.

18. The device of claim 17, wherein the plate comprises steel.

19. The device of claim 1, wherein the plate defines an edge notch extending from the first side to the second side, wherein the edge notch includes a portion of an edge of the plate between the first plate end portion and the second plate end portion.

20. The device of claim 1, wherein the plate defines one or more plate lifting openings extending from the first side to the second side, wherein each of the one or more plate lifting openings is sized to accept a fork of a forklift.

* * * * *